US007013634B2

(12) United States Patent
Pidcock et al.

(10) Patent No.: US 7,013,634 B2
(45) Date of Patent: Mar. 21, 2006

(54) SEALING ARRANGEMENT

(75) Inventors: Anthony Pidcock, Derby (GB); Miklos Gerendas, Zossen (DE); Volker Herzog, Wildau (DE)

(73) Assignee: Rolls-Royce plc, London (GB)

( * ) Notice: Subject to any disclaimer, the term of this patent is extended or adjusted under 35 U.S.C. 154(b) by 136 days.

(21) Appl. No.: 10/714,600

(22) Filed: Nov. 18, 2003

(65) Prior Publication Data

US 2004/0104538 A1 Jun. 3, 2004

(30) Foreign Application Priority Data

Nov. 29, 2002 (GB) ..... 0227842

(51) Int. Cl.
*F02C 7/00* (2006.01)

(52) U.S. Cl. ..... 60/39.821; 60/796

(58) Field of Classification Search ..... 60/39.821, 60/39.827, 39.828, 39.83, 796, 800, 803
See application file for complete search history.

(56) References Cited

U.S. PATENT DOCUMENTS

| | | | | |
|---|---|---|---|---|
| 3,911,672 A * | 10/1975 | Irwin | ..... | 60/796 |
| 5,765,833 A | 6/1998 | Able | | |
| 2003/0163995 A1 * | 9/2003 | White | ..... | 60/800 |

FOREIGN PATENT DOCUMENTS

| | | |
|---|---|---|
| GB | 2151309 A | 7/1985 |
| GB | 2298266 A | 8/1996 |

* cited by examiner

*Primary Examiner*—Louis J. Casaregola
(74) *Attorney, Agent, or Firm*—W. Warren Taltavull; Manelli Denison & Selter PLLC

(57) ABSTRACT

A seal arrangement for a combustor is disclosed. The seal arrangement comprises a seal defining a first aperture, an inner combustor wall defining a second aperture, and an outer combustor wall defining a third aperture. The first and second apertures are arranged in line with each other to receive an article therethrough. The seal is arranged between the inner and outer combustor walls.

42 Claims, 4 Drawing Sheets

SEALING ARRANGEMENT

FIELD OF THE INVENTION

This invention relates to sealing arrangements for combustors. More particularly, but not exclusively, the invention relates to sealing arrangements for combustors in gas turbine engines.

BACKGROUND OF THE INVENTION

In order to ignite the fuel in the combustion chamber of a gas turbine engine, an ignitor plug is arranged to extend into the chamber. The plug extends through a hole in the combustor casing. During operation of the engine, the combustor casing moves relative to the combustion chamber, because of the different thermal expansions. The ignitor hole needs to be larger than the ignitor plug to compensate for this movement.

A seal is used to overcome the problem of leakage through the hole. The seal is mounted in a tower arrangement extending radially outwardly from the combustor. A ring welded on to the top of the tower secures the seal to the tower.

SUMMARY OF THE INVENTION

According to one aspect of the invention there is provided a seal arrangement for a combustor, the seal arrangement comprising a seal defining a first aperture, an inner combustor wall defining a second aperture, and an outer combustor wall defining a third aperture, the first, second and third apertures being arranged in line with each other to receive an article therethrough, wherein the seal is arranged between the inner and outer combustor walls.

Desirably, the seal is secured between the inner and outer walls, and may engage at least one of the inner and outer walls. Desirably, the seal engages both of said inner and outer walls. Preferably, the seal is secured between said walls by the inner and outer walls.

The seal may comprise an outwardly extending portion to engage the, or each, combustor wall. Preferably, the outwardly extending portion extends radially outwardly. The seal member may further include holding means to hold the article. Preferably, the holding means comprises guide member to guide the article into said aperture. The holding means may extend through the aperture in the outer combustor wall. The holding means is preferably conical in configuration.

Preferably, the inner wall comprises a wall member which may comprise a tile. The inner wall may be formed of a plurality of said wall members.

The wall member may comprise a main portion and spacer to space the main portion from the outer wall. Preferably, the spacer extends around the second aperture. The spacer may be annular in configuration. The inner wall may define cooling means around the second aperture. The cooling means may comprise a plurality of cooling channels. The channels may comprise a plurality of cooling holes extending through the inner wall. Alternatively, or in addition, the cooling means may comprise a plurality of cooling grooves extending along an outer surface of the inner wall, desirably, extending to the aperture in the inner wall.

Preferably, at least some of the cooling channels extend inwardly. At least some of the cooling channels may extend at an acute angle to the aperture. Preferably, where the second aperture is generally circular, at least some of the cooling channels are tangential to the second aperture or may have a tangential component to the second aperture.

The cooling channels may be arranged in an array of channels extending around the second aperture. The array of channels is preferably an annular array. Conveniently, the array comprises a plurality of rows of cooling channels, one of said rows preferably comprising a plurality of cooling grooves which may extend along the inner wall. Preferably, the grooves extend to the aperture in said inner wall.

Preferably the plurality of rows of cooling channels comprises a plurality of rows of cooling holes which may extend through the inner wall.

Preferably, the cooling means can receive a cooling fluid from a region between the inner and outer walls.

BRIEF DESCRIPTION OF THE DRAWINGS

An embodiment of the invention will now be described by way of example only, with reference to the accompanying drawings, in which.

DETAILED DESCRIPTION OF THE INVENTION

Figure 1:
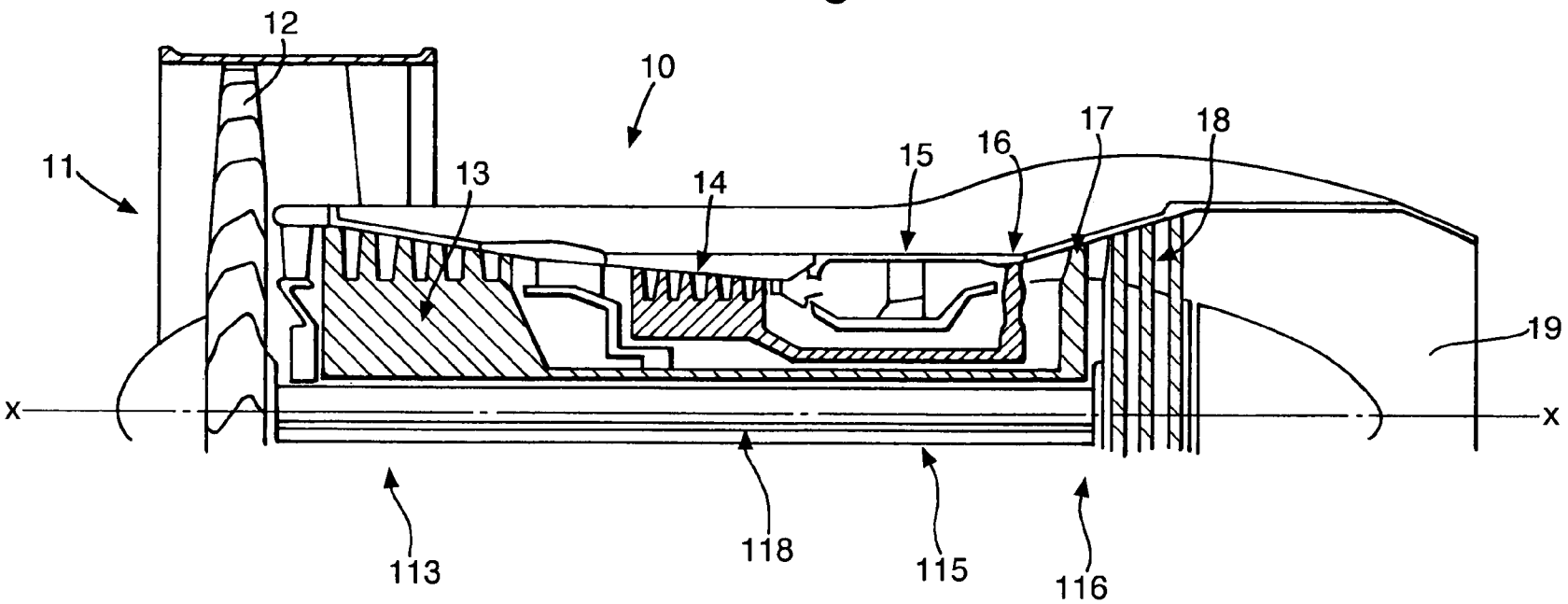
FIG. 1 is a sectional side view of the upper half of a gas turbine engine.

With reference to FIG. 1, a ducted fan gas turbine engine generally indicated at 10 has a principal axis X-X. The engine 10 comprises, in axial flow series, an air intake 11, a propulsive fan 12, a compressor region 113 comprising an intermediate pressure compressor 13, and a high pressure compressor 14, a combustion arrangement 115 comprising a combustor 15, and a turbine region 116 comprising a high pressure turbine 16, an intermediate pressure turbine 17, and a low pressure turbine 18. An exhaust nozzle 19 is provided at the tail of the engine 10.

The gas turbine engine 10 works in the conventional manner so that air entering the intake 11 is accelerated by the fan to produce two air flows: a first air flow into the intermediate pressure compressor 13 and a second air flow which provides propulsive thrust. The intermediate pressure compressor 13 compresses the air flow directed into it before delivering the air to the high pressure compressor 14 where further compression takes place.

The compressed air exhausted from the high pressure compressor 14 is directed into the combustor 15 where it is mixed with fuel and the mixture combusted. The resultant hot combustion products then expand through, and thereby drive the high, intermediate and low pressure turbine 16, 17 and 18 before being exhausted through the nozzle 19 to provide additional propulsive thrust. The high, intermediate and low pressure turbines 16, 17 and 18 respectively drive the high and intermediate pressure compressors 14 and 13 and the fan 12 by suitable interconnecting shafts 118.

Figure 2:
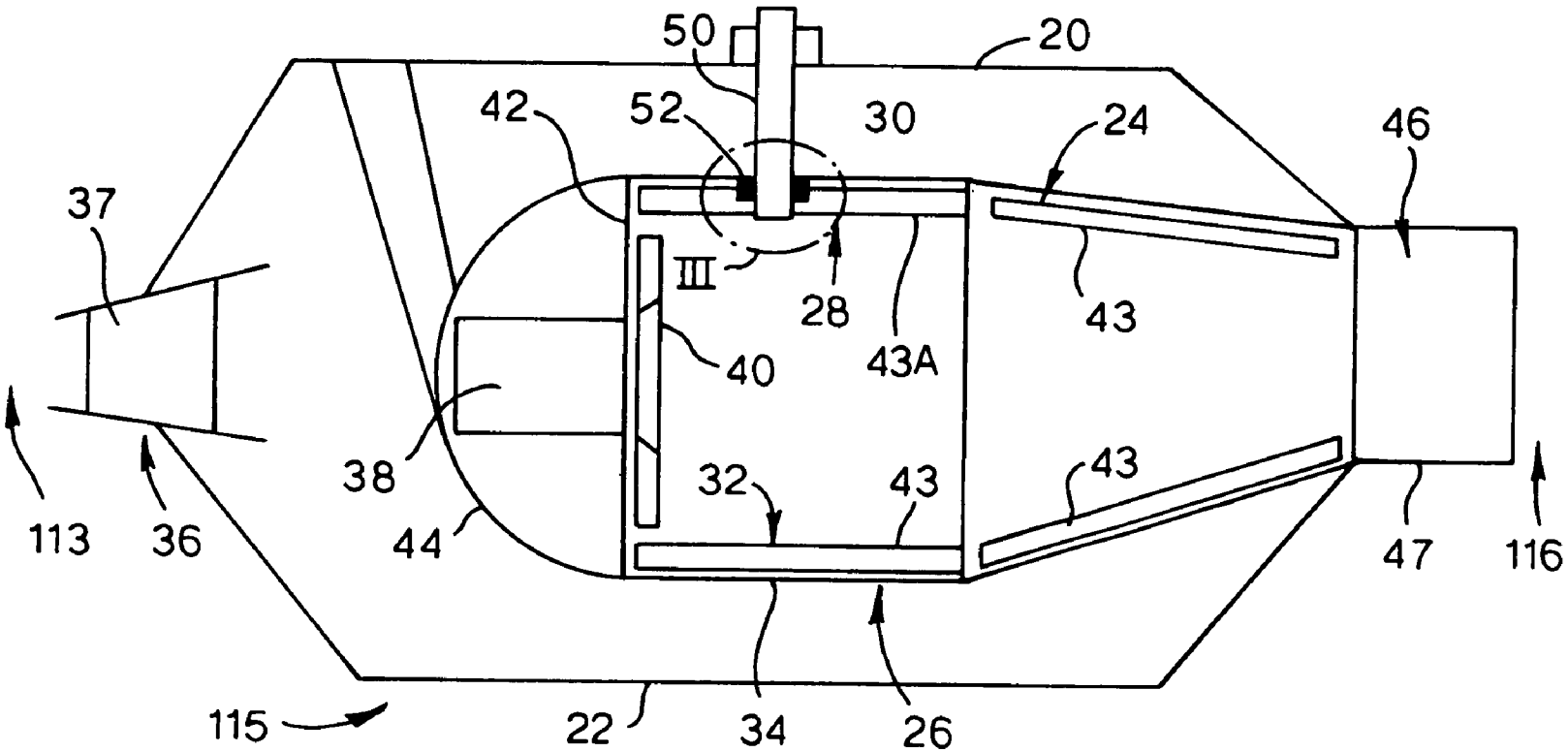
FIG. 2 is a sectional side view of a combustor for use in the gas turbine engine shown in FIG. 1.

Referring to FIG. 2, the combustion arrangement 115 comprises the combustor 15, an outer annular casing 20, and an inner annular casing 22. The combustor 15 comprises an outer annular wall arrangement 24 and an inner annular wall arrangement 26. A combustion chamber 27 is defined between the inner and outer wall arrangements 24, 26.

The outer annular wall arrangement 24 comprises a first annular inner wall 28 and a first annular outer wall 30. Similarly, the inner annular wall arrangement 26 comprises a second annular inner wall 32 and a second annular outer wall 34. The combustor means 15 also includes an inlet arrangement 36 through which compressed gas from the compressor region 113 can pass via a compressor vane 37 to enter the combustor 15. The combustion assembly 115 also includes fuel injection means 38 for injecting fuel into the combustion chamber 27 via a heat shield 40. The heat shield 40 is mounted upon a base plate 42 and a cowl 44 extends over the base plate 42.

An outlet assembly 46 is provided for the combusted gases to pass to the turbine region 116 via a turbine vane 47.

In order to ignite the fuel in the combustor chamber 27 at the start up of the engine 10, there is provided an ignitor plug 50 which extends from a region outside the outer casing 20 to the combustion chamber 27. In order to prevent leakage of gases from the combustion chamber 27 around the ignitor plug 27, a seal 52 is provided in the outer wall arrangement 24.

The first inner annular wall 28 is formed of a plurality of tiles 43. Some of the tile 43 are constructed to allow an ignitor plug 50 to extend therethrough into the combustion chamber 27, as will be explained below. These tiles are designated 43A. The second inner annular wall 32 is also formed of a plurality of tiles 43.

Figure 3:
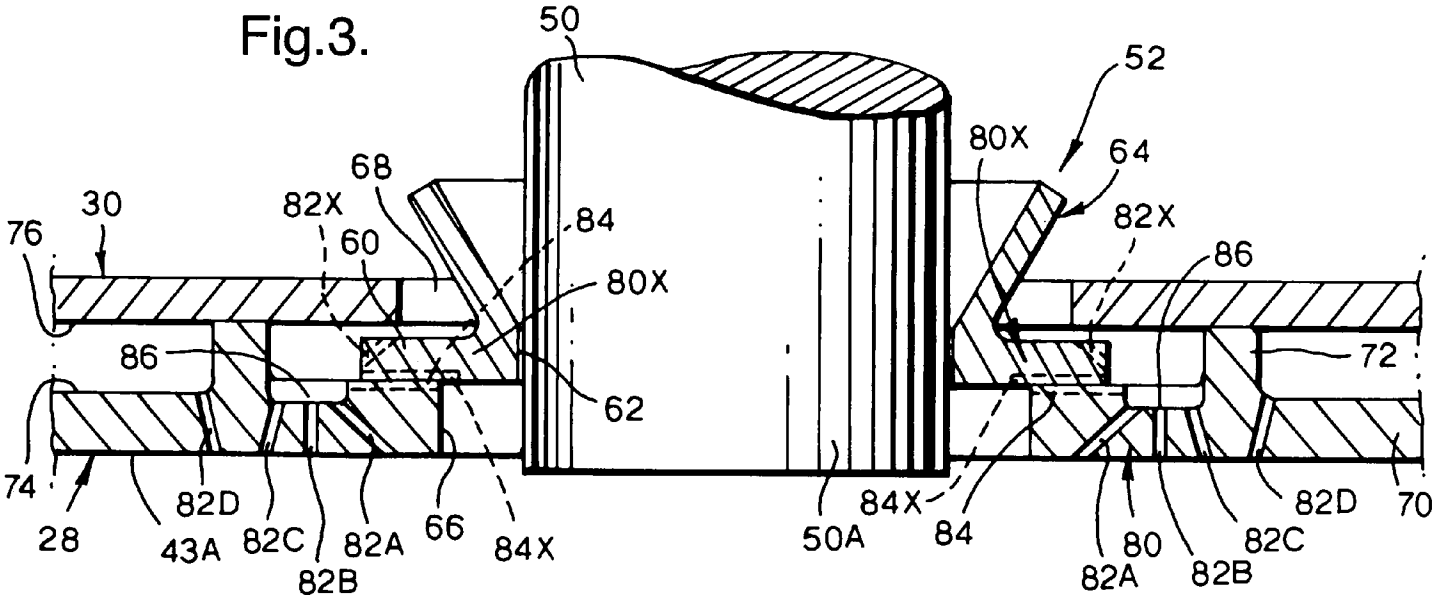
FIG. 3 is a sectional side view of the region of the combustor marked III shown in FIG. 2.

Reference is now made to FIG. 3, which shows the region marked III in FIG. 2., which shows the tile 43A and the seal 52 in more detail.

The seal 52 comprises a radially outwardly extending portion in the form of a flange member 60 which defines a first aperture 62 for the ignitor plug 50. The seal 52 also includes a conical guide member 64 extending outwardly from the flange member 60 from the edge region of the aperture 62.

The tile 43A defines a second aperture 66. The first, second and third apertures 62, 64, 66 are arranged in line with each other so that an inner end region 50A of the ignitor plug 50 can extend into the combustion chamber 27.

The first outer wall 30 of the outer wall arrangement 24 defines a third aperture 68 through which the conical guide member 64 extends.

Thus, as can be seen from FIG. 3, the seal 52 is secured to the combustor 15 by being arranged such that the flange portion 60 is disposed between the first outer wall 30 and the tile 43A.

The tile 43A includes a main portion 70 and an annular spacer 72 extending around the first aperture 62 to space the main portion 70 from the outer wall 30. The main portion 70 has a radially outer surface 74 facing the first outer wall 30. The region of the outer surface 74 in contact with the seal 52 can be planar or curved.

As can be seen, the flange 60 of the seal 52 engages the tile 43A on its radially outer surface 74. If desired, the flange 60 of the seal member 52 could engage the radially inner surface 76 of the outer wall 30. The first outer wall 30 has a radially inner surface 76 facing the first inner wall 28.

The tile 43A is provided with cooling means in the form of a plurality of cooling channels 80. In the embodiment shown, there are two types of cooling channels, namely cooling holes 82 which extend through the body of the main portion 70, as shown, and cooling grooves 84 which extend along the outer annular surface 74 of the main portion 70. The cooling channels 80 are provided to cool the region of the surface 74 of the main portion 70 of the tile 43A that is engaged by the flange member 60 of the seal 52. An annular groove 86 extends around the first aperture 62 inwardly of the spacer 72.

The seal 52 can also be provided with cooling channels 80X. The surface of the seal 52 in contact with the outer surface 74 of the inner wall 28 may define additional cooling grooves 84X. Also, additional cooling holes 82X may extend through the flange member 60 of the seal 52.

Figure 3A:
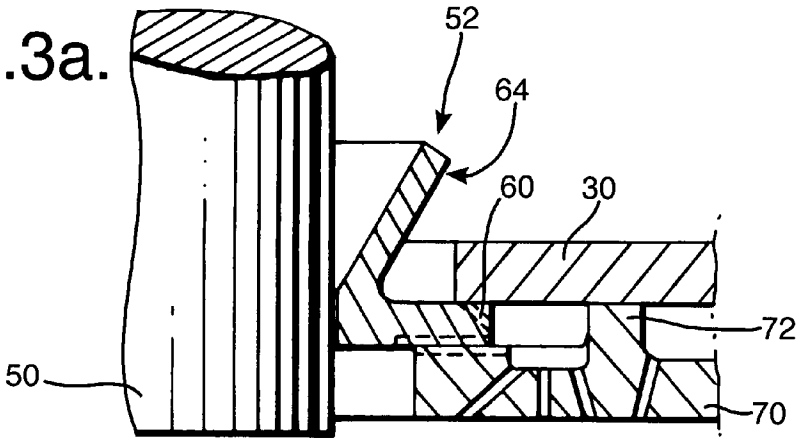
FIG. 3A is a sectional side view of part of the region of the combustor marked III in FIG. 2 showing an alternative the arrangement from FIG. 3.

Referring now to FIG. 3A where like numerals are used in FIG. 3, an alternative securing arrangement to FIG. 3 comprises the flange 60 engaging both the outer annular wall 30 and the inner annular wall 70. Thus, spacer 72 is complementary to the thickness of the flange 60.

Figure 4A:
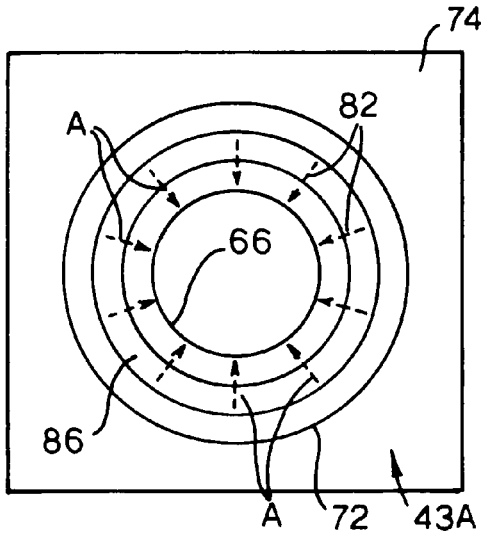
FIGS. 4A and 4B are top plan views of an inner wall tile of FIG. 3, showing cooling holes.
Figure 4B:
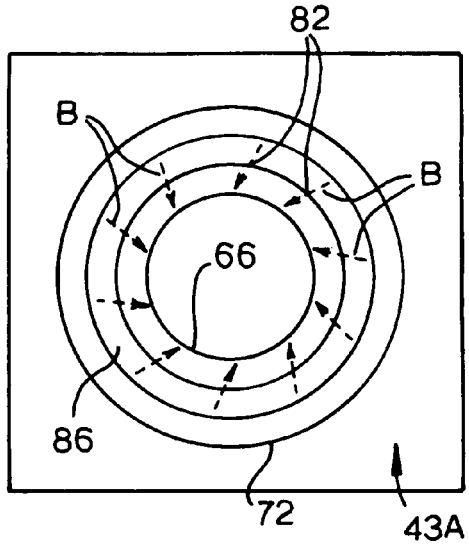

Referring to FIGS. 4A and 4B, there is shown a top plan view of the tile 43A which shows the annular groove 86 arranged radially inwardly of the spacer member 72, and the cooling holes 82 extending radially inwardly from the annular grooves 86. The cooling grooves 84 have been omitted for the sake of clarity.

The arrows A shown in FIG. 4A are intended to represent a first row of the cooling holes 82. As can be seen from FIG. 4A, the first row A of cooling holes 82 direct cooling air radially inwardly towards the second aperture 66. FIG. 4B shows a further set of arrows which represent another annular row B of cooling holes 82, which direct cooling air towards the second aperture 68, but the orientation of the cooling holes 82 forming the second row B has a tangential component thereto. FIG. 4B shows cooling holes 82 having a tangential component providing a constanct swirl. In other embodiments, the swirl can change along the circumference. For example, the cooling holes 82 shown in FIG. 4B and represented by the arrows B can be arranged in two distinct groups, each group having an opposing sense of rotation.

Each of the rows of cooling holes 82 which are represented by the arrows A and B in FIGS. 4A and 4B are provided with air from the annular groove 86. The cooling holes 82 represented by the arrows A may be at a first level within the main portion 70 of the tile 43A, and the cooling holes 82 represented by the arrows B may be at a second level within the main portion 70 of the tile 43A. It will be appreciated by those skilled in the art that the precise orientations of cooling holes 82 will depend upon the conditions inside and outside the combustion chamber 27.

Figure 5A:
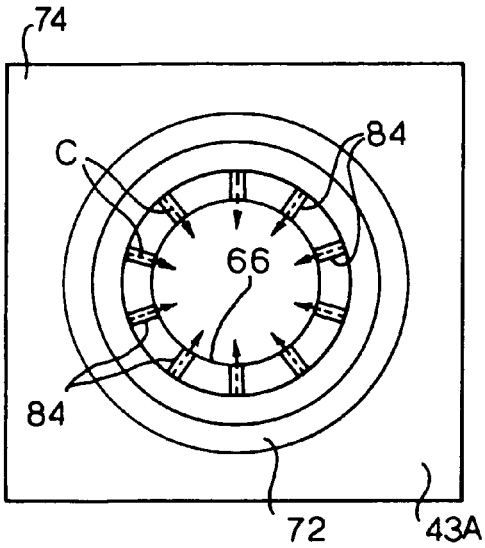
FIGS. 5A and 5B are top plan views of the wall tiles shown in FIG. 3, indicating the cooling grooves.
Figure 5B:
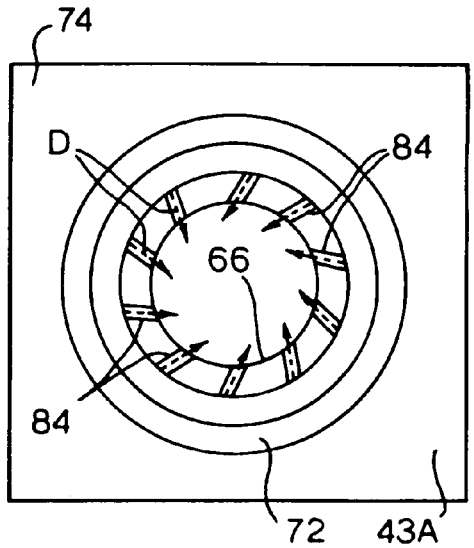

Referring to FIGS. 5A and 5B, there are again shown top plan views of the tile 43A shown in FIG. 3, in which the cooling grooves 84 are shown. The cooling holes 82 are omitted for clarity. The cooling grooves 84 direct air along the surface 74 of the main portion 70 of the tile 43A. The cooling fluid directed through the cooling grooves 84 to be divided from the annular groove 86. The arrows C in FIG. 5A shows the direction of air flowing through the radially inwardly directed cooling grooves 84. The arrows D in FIG. 5B shows that air is directed with a tangential component relative to the second aperture 66. FIG. 5B shows cooling grooves 84 having a tangential component providing a constant swirl. In other embodiments, the swirl can change along the circumference. For example, the cooling grooves 84 shown in FIG. 5B, and having a flow of air represented by the arrows D, can be arranged in two distinct groups, each group having an opposing sense of rotation. The purpose of the cooling grooves 84 is to provide further cooling in the event that cooling fluids supplied by the cooling holes 82 is not sufficient and may provide cooling for the main portion 60 of the seal 52.

Referring back to FIG. 3 there is shown four rows of cooling holes 82A, 82B, 82C and 82D where each row is radially further outwardly to the previous row. In such a case, the innermost row is provided with a mainly radially inward orientation, and the orientation of each subsequent row outwardly therefrom is provided with an increased tangential component.

There is thus described a seal arrangement 52 for holding an ignitor plug 50 in a combustion chamber 27 of a gas turbine engine. The preferred embodiment has the advantage over prior art arrangements which feature tower members are reduced weight, parts count and cost.

Various modifications can be made without departing from the scope of the invention, for example the arrangement of cooling holes and cooling channels can be altered. Also, the above arrangement could be used for other articles to be inserted into the combustion chamber, for example a Helmholtz resonator.

Whilst endeavouring in the foregoing specification to draw attention to those features of the invention believed to be of particular importance it should be understood that the Applicant claims protection in respect of any patentable feature or combination of features hereinbefore referred to and/or shown in the drawings whether or not particular emphasis has been placed thereon.

We claim:

1. A seal arrangement for a combustor, the seal arrangement comprising a seal defining a first aperture and having a radially outwardly extending flange member, the combustor being defined by an inner annular wall defining a second aperture, and an outer annular wall defining a third aperture, the first, second and third apertures being arranged in line with each other to receive an article therethrough, wherein the seal is secured to the combustor by the flange member being disposed between the inner and outer annular walls.

2. A seal arrangement according to claim 1, wherein the seal engages at least one of the inner and outer walls.

3. A seal arrangement according to claim 1 wherein the seal comprises an outwardly extending flange member to engage the, or each, annular wall.

4. A seal arrangement according to claim 3, wherein the outwardly extending flange member extends radially outwardly.

5. A seal arrangement according to claim 1, wherein holding means to hold the article are provided, the holding means extending through the aperture in the outer annular wall.

6. A seal arrangement according to claim 5, wherein the holding means comprises a guide member to guide the article into said apertures.

7. A seal arrangement according to claim 5, wherein the holding means is conical in configuration.

8. A seal arrangement according to claim 1, wherein the inner wall comprises a plurality of wall members.

9. A seal arrangement according to claim 8, wherein one of the wall members comprises a main portion and a spacer to space the main portion from the outer wall, the spacer extending around the second aperture.

10. A seal arrangement according to claim 1, wherein the inner wall defines cooling means around the second aperture.

11. A seal arrangement according to claim 10, wherein the cooling means comprises a plurality of cooling channels and a cooling fluid supply groove extending around the second aperture, wherein the cooling channels extend from the supply groove.

12. A seal arrangement according to claim 11, wherein the cooling channels comprise a plurality of holes extending through the inner wall.

13. A seal arrangement according to claim 11, wherein the cooling channels comprise a plurality of grooves extending along an outer surface of the inner wall to said second aperture therein.

14. A seal arrangement according to claim 11, wherein at least some of the cooling channels extend inwardly towards the second aperture.

15. A cooling arrangement according to claim 11 wherein at least some of the cooling channels extend at an acute angle to the second aperture.

16. A seal arrangement according to claim 11, wherein the second aperture is generally circular in configuration, at least some of the cooling channels are tangential to the second aperture.

17. A seal arrangement according to claim 11, wherein the cooling channels are arranged to provide an array of channels extending around the second aperture.

18. A sealing arrangement according to claim 17, wherein the array of channels is an annular array and comprises a plurality of rows of cooling channels.

19. A sealing arrangement according to claim 18, wherein one of said rows comprises a plurality of cooling grooves extending along the inner wall.

20. A sealing arrangement according to claim 18, wherein the plurality of rows of cooling channels comprises a plurality of rows of cooling holes extending through the inner wall.

21. A sealing arrangement according to claim 1 wherein the seal defines seal cooling means around the first aperture.

22. A sealing arrangement according to claim 21, wherein the seal cooling means comprises a plurality of seal cooling holes extending through an outwardly extending portion of the seal.

23. A sealing arrangement according to claim 22, wherein the seal cooling means comprises a plurality of seal cooling grooves in the outwardly extending portion, extending along a surface of the seal in contact with the inner wall.

24. A combustion arrangement comprising a combustor having a sealing arrangement as claimed in claim 1.

25. A gas turbine engine incorporating a combustion arrangement as claimed in claim 24.

26. A sealing arrangement according to claim 11 wherein the second aperture is generally circular in configuration, at least some of the cooling channels have a constant tangential component thereto.

27. A sealing arrangement according to claim 11 wherein the second aperture is generally circular in configuration, at least some of the cooling channels have a variable tangential component thereto.

28. A seal arrangement for a combustor, the seal arrangement comprising a seal defining a first aperture, an inner combustor wall defining a second aperture, and an outer combustor wall defining a third aperture, the first, second and third apertures being arranged in line with each other to receive an article therethrough, wherein the seal is arranged between the inner and outer combustor walls and wherein the seal engages both of the inner and outer walls and is secured between said walls by said inner and outer walls.

29. A seal arrangement for a combustor, the seal arrangement comprising a seal defining a first aperture, an inner combustor wall defining a second aperture, and an outer combustor wall defining a third aperture, the first, second and third apertures being arranged in line with each other to receive an article therethrough, wherein the seal is arranged between the inner and outer combustor walls and wherein the inner wall defines cooling means around the second aperture.

30. A seal arrangement according to claim 29, wherein the cooling means comprises a plurality of cooling channels and a cooling fluid supply groove extending around the second aperture, wherein the cooling channels extend from the supply groove.

31. A seal arrangement according to claim 30, wherein the cooling channels comprise a plurality of holes extending through the inner wall.

32. A seal arrangement according to claim 30, wherein the cooling channels comprise a plurality of grooves extending along an outer surface of the inner wall to said second aperture therein.

33. A seal arrangement according to claim 30, wherein at least some of the cooling channels extend inwardly towards the second aperture.

34. A cooling arrangement according to claim 30 wherein at least some of the cooling channels extend at an acute angle to the second aperture.

35. A seal arrangement according to claim 30, wherein the second aperture is generally circular in configuration, at least some of the cooling channels are tangential to the second aperture.

36. A seal arrangement according to claim 30, wherein the cooling channels are arranged to provide an array of channels extending around the second aperture.

37. A sealing arrangement according to claim 36, wherein the array of channels is an annular array and comprises a plurality of rows of cooling channels.

38. A sealing arrangement according to claim 37, wherein one of said rows comprises a plurality of cooling grooves extending along the inner wall.

39. A sealing arrangement according to claim 37, wherein the plurality of rows of cooling channels comprises a plurality of rows of cooling holes extending through the inner wall.

40. A sealing arrangement for a combustor, the seal arrangement comprising a seal defining a first aperture, an inner combustor wall defining a second aperture, and an outer combustor wall defining a third aperture, the first, second and third apertures being arranged in line with each other to receive an article therethrough, wherein the seal is arranged between the inner and outer combustor walls and wherein the seal defines seal cooling means around the first aperture.

41. A sealing arrangement according to claim 40, wherein the seal cooling means comprises a plurality of seal cooling holes extending through an outwardly extending portion of the seal.

42. A sealing arrangement according to claim 41, wherein the seal cooling means comprises a plurality of seal cooling grooves in the outwardly extending portion, extending along a surface of the seal in contact with the inner wall.

* * * * *